US005172134A

United States Patent [19]

Kishida et al.

[11] Patent Number: 5,172,134

[45] Date of Patent: Dec. 15, 1992

[54] INK JET RECORDING HEAD, DRIVING METHOD FOR SAME AND INK JET RECORDING APPARATUS

[75] Inventors: Hideaki Kishida, Yamato; Akira Katayama; Kimiyuki Hayasaki, both of Yokohama, all of Japan

[73] Assignee: Canon Kabushiki Kaisha, Tokyo, Japan

[21] Appl. No.: 501,153

[22] Filed: Mar. 29, 1990

[30] Foreign Application Priority Data

| | | | |
|---|---|---|---|
| Mar. 31, 1989 | [JP] | Japan | 1-082305 |
| Mar. 31, 1989 | [JP] | Japan | 1-082311 |
| Mar. 27, 1990 | [JP] | Japan | 2-075470 |

[51] Int. Cl.[5] ..... B41J 2/05

[52] U.S. Cl. ..... 346/1.1; 346/140 R

[58] Field of Search ..... 346/140 R, 1.1, 75; 400/126

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,376,945 | 3/1983 | Hara et al. | 346/140 R |
| 4,459,600 | 7/1984 | Sato et al. | 346/140 R |
| 4,463,359 | 7/1984 | Ayata et al. | 346/140 R |
| 4,558,332 | 12/1985 | Takahashi | 346/140 R |
| 4,558,333 | 12/1985 | Sugitani et al. | 346/140 R |
| 4,712,172 | 12/1987 | Kiyohara et al. | 346/1.1 |
| 4,719,472 | 1/1988 | Arakawa | 346/140 R |
| 4,723,129 | 2/1988 | Endo et al. | 346/1.1 |
| 4,740,796 | 4/1988 | Endo et al. | 346/1.1 |
| 4,769,653 | 9/1988 | Shimoda | 346/140 R |
| 4,788,563 | 11/1988 | Omo et al. | 346/140 R |
| 4,791,435 | 12/1988 | Smith et al. | 346/140 R |
| 4,854,754 | 8/1989 | Miura et al. | 346/140 R |

FOREIGN PATENT DOCUMENTS

| | | |
|---|---|---|
| 3311735 | 10/1983 | Fed. Rep. of Germany . |
| 59-123670 | 7/1984 | Japan . |
| 2159465 | 3/1988 | United Kingdom . |
| 2169856 | 10/1989 | United Kingdom . |
| 2169855 | 11/1989 | United Kingdom . |

*Primary Examiner*—Benjamin R. Fuller
*Assistant Examiner*—Alrick Bobb
*Attorney, Agent, or Firm*—Fitzpatrick, Cella, Harper & Scinto

[57] ABSTRACT

A recording method causes recording on a recording material by ejection of ink, wherein after electric power sufficient to eject the ink is supplied to a recording device to effect recording in a predetermined region, electric power insufficient to eject the ink is supplied to the recording device.

18 Claims, 11 Drawing Sheets

INK JET RECORDING HEAD, DRIVING METHOD FOR SAME AND INK JET RECORDING APPARATUS

FIELD OF THE INVENTION AND RELATED ART

The present invention relates to an ink jet recording head, a driving method for the same and an ink jet recording apparatus wherein ink is ejected to record information on a recording material.

The recording apparatus using the driving method for the ink jet recording head according to this invention is usable, for example, with a printer as peripheral equipment of information processing apparatus such as a computer, a copying apparatus having a reader, a wordprocessor having key input functions, an electronic typewriter and a facsimile machine having information transmitting and receiving functions.

In an ink jet recording method, droplets of ink are ejected through various systems, and the droplets are deposited to form an image on the recording material. Among such systems, an ink jet recording apparatus using heat energy for formation of the droplets has the advantage that the recording head therefor can be easily formed as multi-nozzle head having a number of nozzles at high density, and therefore high resolution and high quality images can be produced at a high speed. In one of such ink jet recording apparatuses, the recording head is of a so-called full-multi-type in which the ejection outlets are disposed to cover the entire width of the recording material (line printer recording head), wherein on one and the same substrate, there are disposed plural liquid droplet forming means for ejecting ink droplets through ejection outlets by application of thermal energy. Such droplet forming means includes electrothermal transducers for producing heat to heat the ink by supplying electric current pulses, and corresponding integrated circuits (driver IC) for driving the electrothermal transducers.

FIG. 1 shows an example of electric structure of the ink jet recording head of this type. FIG. 2 shows the driving timing thereof. The recording data (SI: 13-*b*) having the same bit number as electrothermal transducers 7 are sequentially supplied to a shift register 4 in the driver IC3 in sychronism with a data transfer clock (CLK). After all the data are transferred, they are read in a latching circuit 5 in response to a latching signal (LAT). Thereafter, in response to a divided driving signal (EI) and divided drive signal transfer clock (ECK), a flip-flop circuit (F/F) 6 activates sequentially the driver IC IC3, by which the electrothermal transducers 7 for which the recording data signals are "ON" are selectively energized only during the ON-state of the pulsewidth setting signal (ENB) so as to eject the liquid.

In the apparatus of this kind, the recording liquid which will hereinafter be called "ink," is directly ejected from the ejection outlet of the recording head, and therefore particular considerations which are not necessary in other types of recording apparatus are required in order to maintain the ink in an ejectable state at all times.

More particularly, since the ink remains in the liquid passage of the recording head when the recording operation is not effected, some measure is required, as the case may be, to prevent changes in the properties of the ink, such as an increase of the viscosity attributable to the drying and/or evaporation of the ink in the liquid passage. A measure is known wherein the recording head is provided with a so-called capping means to cover the ejection outlets of the recording head when the recording operation is not performed to prevent the ink from drying or evaporating.

However, it is possible that the increase of the ink viscosity is not avoidable only by the drying preventing means described above, particularly when the apparatus is kept at rest for a long period. Therefore, in addition to the capping means, additional measures are taken. In one example, the air in the cap covering the recording head is sucked to impart negative pressure to the ejection outlets to suck ink out of the liquid passages. In another example, pressure is applied to the ink supply system using a pump to eject the ink having been changed in its property through the ejection outlets. In a further example, the ink is ejected (idle ejection) to a portion other than the recording material, for example, to the capping means, from all of the ejection outlets to forcibly discharge the ink having increased viscosity in the passage. The means for doing such measures are called a recovery mechanism or system.

However, it is desirable that the recovery mechanism be automatically driven upon actuation of a main switch, and then during a recording operation it be driven at the largest possible intervals, in order to reduce the consumption of the ink. In order to prevent property changes in the ink in passages not driven during the recording operation, it would be required that the recording operation be interrupted at short intervals to perform the ejection recovery process. This, however, decreases the recording speed.

Particularly in a liquid jet recording apparatus using a recording head having a number of ejection outlets along a line, there are ejection outlets that statistically are infrequently used for recording. In such ejection outlets, the intervals between adjacent ejections are very long. Therefore, the frequency of the ejection drives are different in the different ejection outlets. The ink in the passages for which the ejection intervals are long or in which the number of ejections is small, is increased in viscosity due to drying depending on the ambient conditions such as humidity or temperature. Ink ejection through such ejection outlets becomes unstable, even to such an extent that ink is not ejected.

Under the circumstances, and for the purpose of providing good ejection of the ink having an increased viscosity due to low temperature or the like, the electrothermal transducers are energized to such an extent that ink is not ejected when the ejection signals are not supplied thereto, thus heating the ink therein (preliminary heating) in order to maintain the temperature of the ink within a predetermined range. Various methods for accomplishing this have been proposed.

For example, U.S. Pat. No. 4,463,359 filed on Mar. 24, 1980 and issued on Jul. 31, 1984, assigned to the assignee of this application, proposes that the applied pulse has a waveform corresponding to a combination of the recording pulse and the preliminary heating pulse, by which the preliminary heating is performed.

U.S. Pat. No. 4,376,945 filed on May 27, 1981 and issued on Mar. 15, 1983, assigned to the assignee of this application, proposes that a heater is provided on an outside of a common liquid chamber for the preliminary heating.

U.S. Pat. No. 4,719,472 filed on Jul. 6, 1983, issued on Jan. 12, 1988 and assigned to the assignee of this application, proposes that a substrate constituting a part of the common liquid chamber is provided with a built-in preliminary heating element.

U.S. Pat. No. 4,712,172 filed on Apr. 12, 1985, issued on Dec. 8, 1987 and assigned to the assignee of this application, proposes that the preliminary heating is effected after a predetermined period of time elapses, or immediately after the main switch is actuated.

U.K. Patent No. 2,159,465 filed on May 24, 1985, published on Dec. 4, 1985, issued on Mar. 9, 1988 and assigned to the assignee of this application, proposes the preliminary heating is performed with application pulsewidth which is changed in accordance with ambient conditions.

U.K. Patent No. 2,169,855 filed on Dec. 20, 1985, published on Jul. 23, 1986, issued on Nov. 8, 1989 and assigned to the assignee of this application, proposes the preliminary heating is carried out using an externally heating element in accordance with the ambient conditions.

U.K. Patent No. 2,169,856 filed on Dec. 23, 1985, published on Jul. 23, 1986, issued on Oct. 25, 1989 and assigned to the assignee of this application, proposes the preheating condition is changed between immediately after the main switch is actuated and after a resting period elapses.

The present invention is a further improvement of the above-mentioned proposals.

SUMMARY OF THE INVENTION

It is a principal object of the present invention to provide an ink jet recording head, a driving method for the same and an ink jet recording apparatus wherein the quality of the recording is stably maintained.

It is another object of the present invention to provide an ink jet recording head, a driving method for the same and an ink jet recording apparatus wherein the preliminary heating operation is effectively performed.

It is a further object of the present invention to provide an ink jet recording head of a so-called full-multi-type which can perform a good recording operation.

It is a yet further object of the present invention to provide a driving method for an ink jet recording head an an ink jet recording apparatus, wherein the good recording operation is possible using the full-multi-type ink jet recording head.

It is a further object of the present invention to provide an ink jet recording head, a driving method therefore and an ink jet recording apparatus wherein the preheating is effectively carried out in a relatively simple manner; the temperature variation among the ejection outlets is minimized; the frequency of the recovery operations of the recovery mechanism is significantly reduced; and therefore, a high speed recording operation is possible with a stabilized record quality.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

The preferred embodiments of the present invention will be described in conjunction with accompanying drawings.

In a first embodiment, the ink jet recording apparatus comprises a recording head having a plurality of electrothermal transducers for producing thermal energy contributable to the ink ejection, ejecting drive means for supplying drive signals to the electrothermal transducers of the recording head in accordance with the data to be recorded to eject the ink, and heat driving means for supplying a drive signal enough to heat the ink but not enough to eject the ink to the electrothermal transducers after each unit driving operations by said ejection driving means.

In the driving method for driving a recording head of the ink jet recording apparatus having the plurality of electrothermal transducers for producing thermal energy contributable to the ink ejection, according to this embodiment, the plurality of electrothermal transducers of the recording head are supplied alternately with driving signals corresponding to the data to be recorded and the heating drive signals not enough to the eject the ink.

Figure 1:
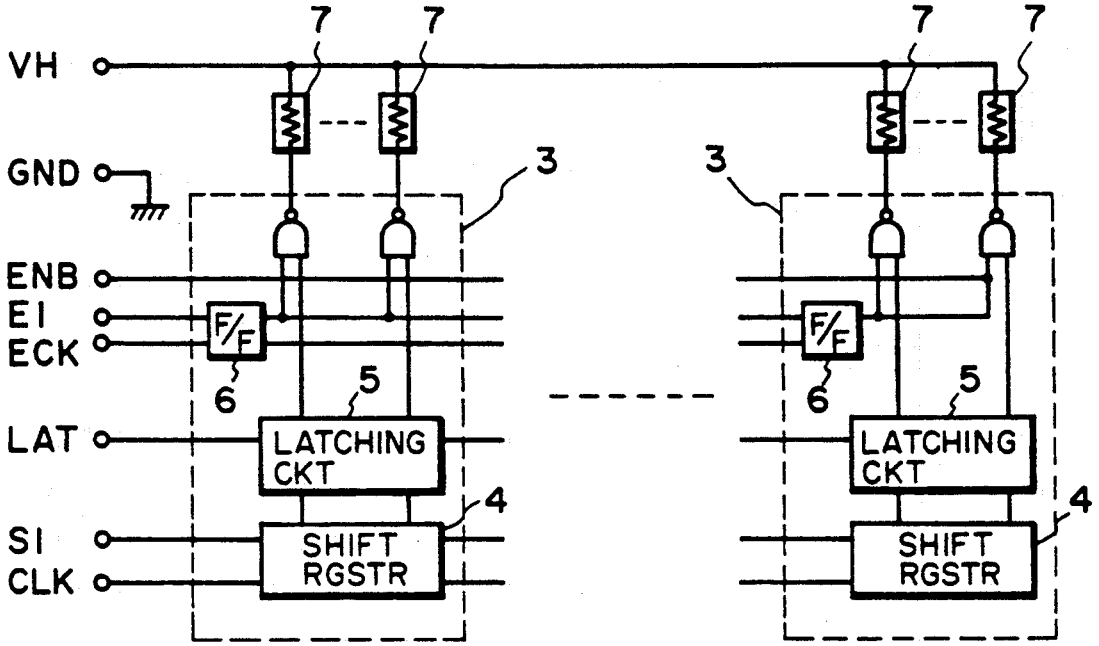
FIG. 1 PRIOR ART
FIG. 1 is a block diagram of a generally used electrical structure of a recording head.
Figure 2:
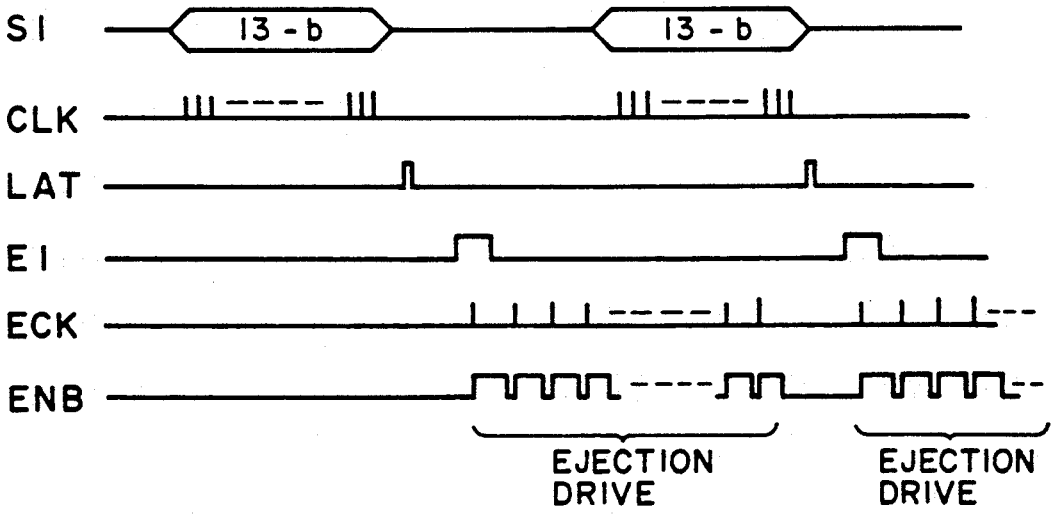
FIG. 2 PRIOR ART
FIG. 2 is a timing chart showing conventional drive timing.
Figure 3:
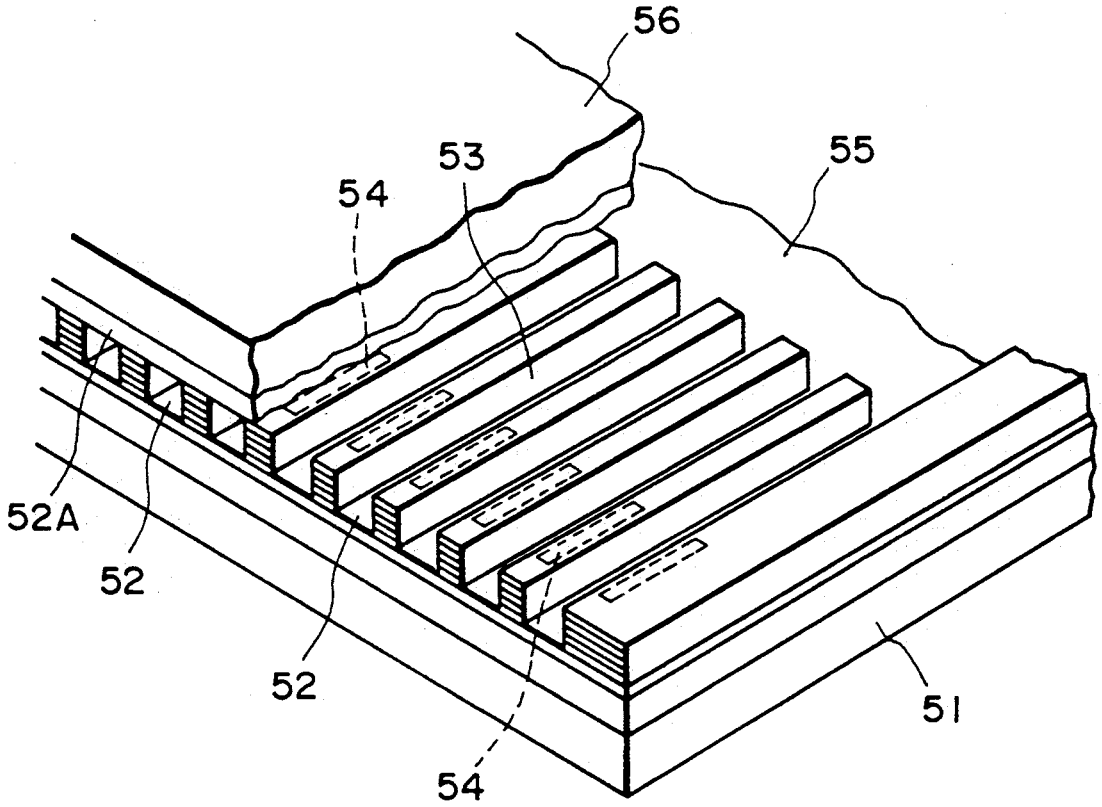
FIG. 3 is a perspective view of an example of an ink jet recording head to which the present invention is applicable.

Referring to FIG. 3, there is shown in a partly broken perspective view an ink jet recording head to which the present invention is applicable. The recording head is of a so-called full-multi-type in which the ejection outlets are aligned in a range covering the entire width of the recording material. The recording head includes heat generating resistors 54 constituting the electrothermal transducer elements 7 for producing heat upon electric energy application thereto to produce film boiling so as to form a bubble in the ink to eject the ink (that is, to change the state of the ink). The ink is ejected by the development and contraction of the bubble. The heat generating resistors 54 are formed on a substrate 51 through a manufacturing process which is similar to a semiconductor manufacturing process, the recording head further comprising liquid passage forming portions, corresponding to the heat generating resistors 54.

The portions 52A are effective to form ejection outlets 52 and liquid passages 53 communicating therewith, respectively. A top plate 56 covers the liquid passage forming portions to form the liquid passages. A liquid chamber 55 communicates commonly with all of the liquid passages 53 and store in the recording head the ink supplied from an unshown ink supply source.

Figure 4A:
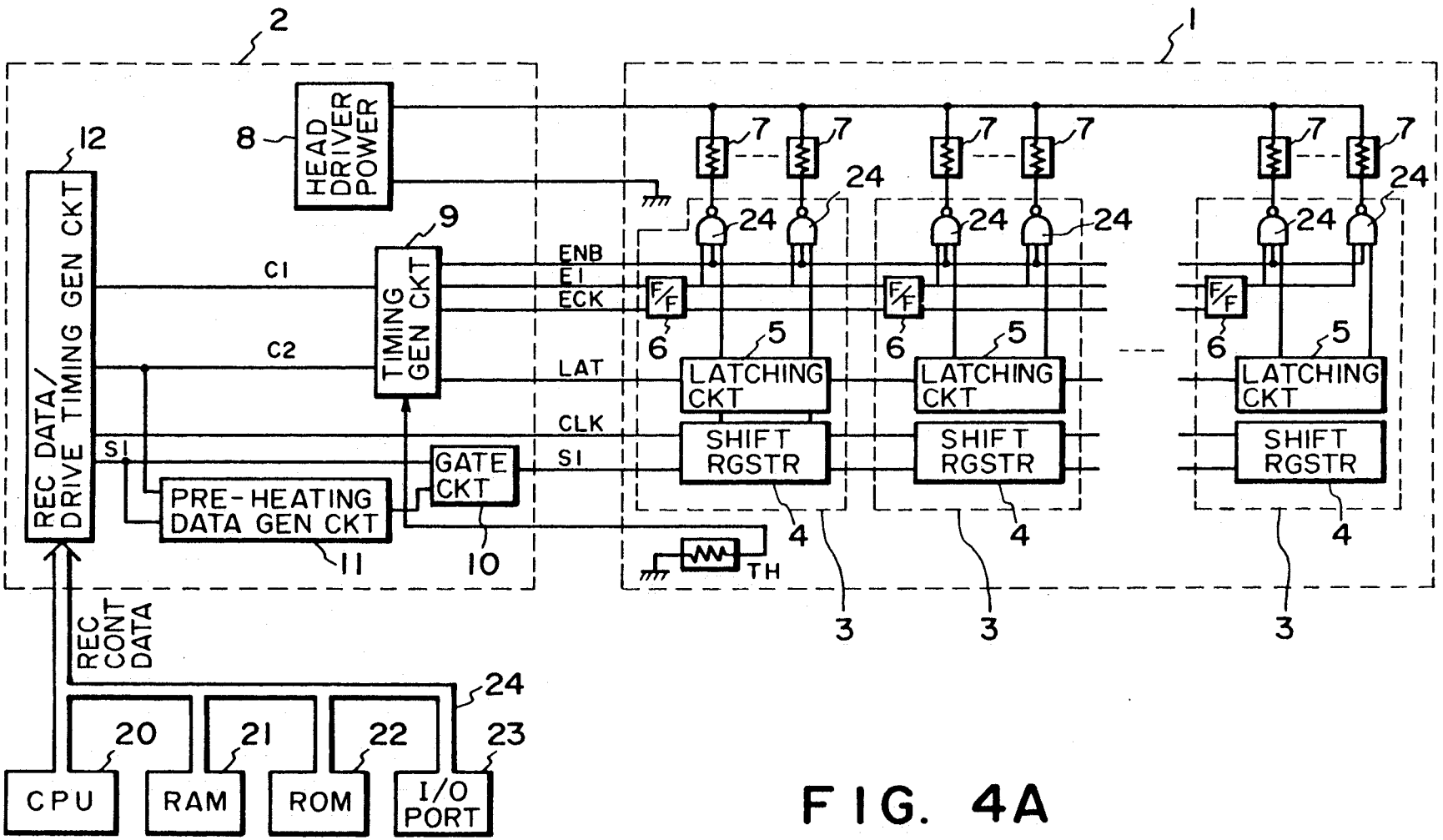
FIG. 4A is a block diagram showing an example of a drive control system according to an embodiment of the present invention.

FIG. 4A shows an example of a drive control system for heat-driving the ink jet recording head in accordance with image information, the ink jet recording head 1 having the mechanical structure shown in FIG. 3. The control system comprises a head driving circuit 2 according to this embodiment. The head driving circuit 2 includes a head driving electric power source 8, a timing generating circuit 9, a gate circuit 10, a preliminary heating data generating circuit 11 and a recording data/drive timing generating circuit 12.

The timing generating circuit 9 produces a pulse width setting signal ENB, a divided drive signal EI, a divided drive signal transfer clock ECK and a latching signal LAT in accordance with control signals C1 and C2 of the recording data/drive timing generating circuit 12, and they are supplied to the driver IC (integrated circuit) IC3 of the recording head. The preliminary heating data generating circuit 11 receives the recording data SI for one line from the recording data/drive timing generating circuit 12 in response to the control signal C2. The circuit 11 stores, as preliminary heating data, data provided by reversing the received data, and it produces the preliminary heating data after ejection drive for one line. The gate circuit 10 receives the recording data for one line from the recording data/drive timing generating circuit 12 and the preliminary heating data from the preliminary heating data generating circuit 11, and transfers them to a shift register 4.

The recording data/drive timing generating circuit 12 sequentially outputs the recording data for one line to perform the ejection drive for ejecting the ink, and during the drive, the preliminary heating data generating circuit 11 produces the preliminary heating data to perform the preliminary heating drive. Therefore, in this embodiment, the ejection drives and the preliminary heating drives are alternately carried out. The preliminary heating drive is performed entirely or partly using the recording material feeding period after completion of the recording on one recording line, whereby the recording throughput does not significantly decrease. Designated by a reference numeral 24 is an AND circuit.

A controller controls the entire recording apparatus and comprises a CPU (central processing unit) 20 such as a microprocessor, ROM 22 for storing control program for the CPU 20 and various data, RAM 21 used as a working area of the CPU 20 and I/O ports 23. They are electrically connected by a bus line 24, wherein the record control data are supplied to the recording data/drive timing generating circuit 12. An ambient temperature detecting element TH is formed on the head substrate to detect all or part of the temperature of the head, the external temperature and the like and supplies the detected temperature information to the timing generating circuit 9. Therefore, the preliminary heating at the time of the initial start can be performed in accordance with the ambient temperature.

Figure 4B:
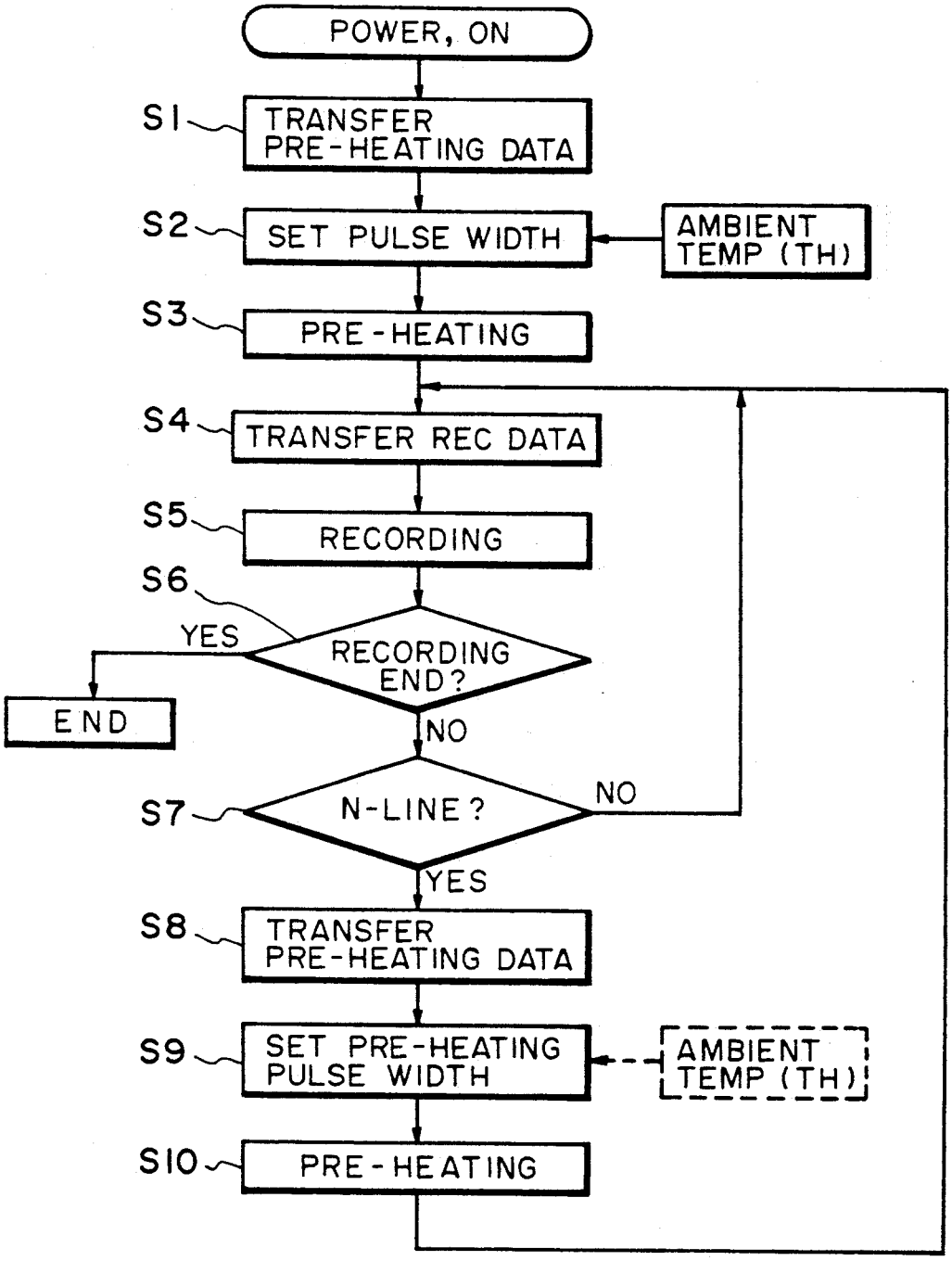
FIG. 4B is a flow chart illustrating the drive control by the control system of FIG. 4A.

FIG. 4B is a flow chart illustrating the operation of the drive control of the circuit shown in FIG. 4A.

When the main switch of the recording apparatus is actuated, the preliminary heating data are transferred to the shift register 4 from the preliminary heating data generating circuit 11 through a gate 10 (step S1). On the other hand, the temperature information is supplied to the timing generating circuit 9 from the ambient temperature detecting element TH. The pulsewidth setting signal ENB which is dependent on the temperature information is supplied to the driver IC3 of the recording head 1 (step S2). Thus, the preliminary heating depending on the ambient temperature is effected for all of the nozzles, at the time of the initial starting operation (step S3). Subsequently, the recording data SI for one line are transferred to the shift register 4 from the recording data/drive timing generating circuit 12 (step S4). In accordance with the recording data SI, selected electrothermal transducers 7 produce heat to eject the ink through the corresponding ejection outlets (step S5). If the next recording data are not transferred even after a predetermined time period elapses, the recording operation ends (step S6). When the recording data SI are transferred for N lines sequentially ($N \geqq 1$), and the recording for the N lines is completed, the preliminary heating data are transferred from the preliminary heating data generating circuit 11 to the shift register 4 through the gate circuit 10 (steps S7 and S8). On the other hand, a predetermined pulsewidth setting signal ENB is supplied to the driver IC3 of the recording head 1 from the timing generating circuit 9, so that the preliminary heating operation is carried out during the recording operation (steps S9 and S10). Here, the preliminary heating during the recording operation is not limited to the operation with a predetermined constant pulse width, but it may be performed with the pulse width which is dependent on the ambient temperature similarly to the preliminary heating at the time of the initial starting operation (main switch "ON"). In many cases, the pulse width during the recording is smaller than the pulse width for the preliminary heating during the start-up operation. The preliminary heating during the recording operation may be effected using the reversed data, that is, the data provided by reversing the recording data, or with all black data to effect the preliminary heating to all of the nozzles. It is possible, for example, that in the case where $N=1$, the preliminary heating is effected with the reversed data, whereas in the case where $N>1$, the preliminary heating is performed with the all black data. They can be properly selected by one skilled in the art.

Figure 5:
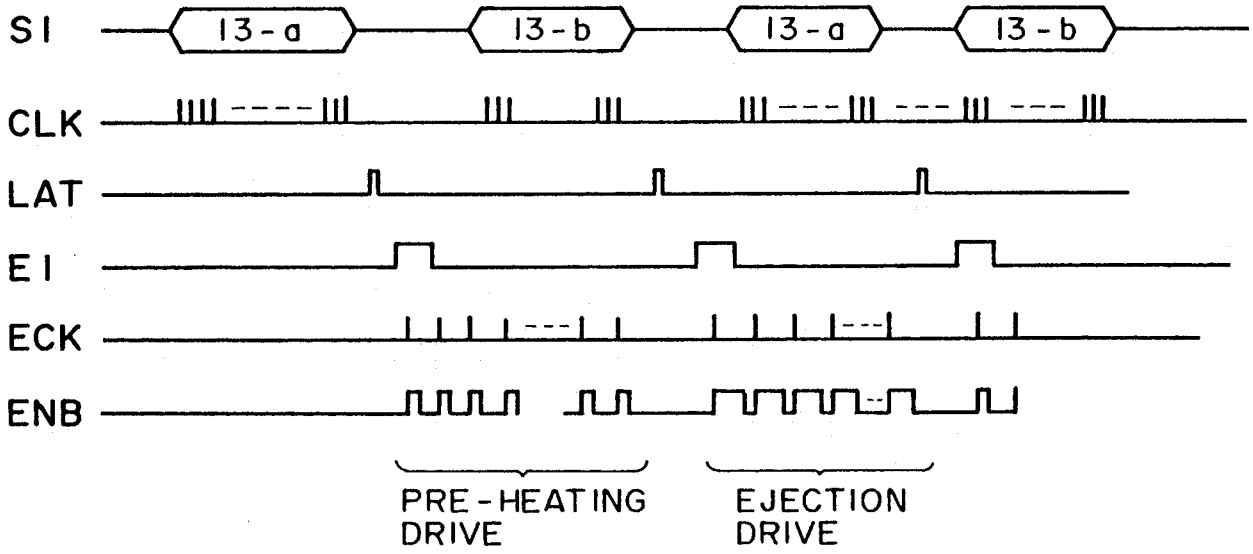
FIG. 5 is a timing chart illustrating the drive timing of the drive control system of FIG. 4A.

Referring to FIG. 5, there is shown drive timing in the apparatus of this embodiment. The recording data signal SI transmitted to the ink jet recording head 1 includes the recording data (13-*b*) having the same bit number as electrothermal transducer elements 7 and the preliminary heating data (13-*a*) which are obtained by reversing the recording data. The ink jet recording head 1 is supplied alternately with the preliminary heating data 13-*a* and the recording data 13-*b*. After either of the data are received and are aligned in the shift register 4, they are read in the latching circuit 5 in the driver IC3 by the latching signal LAT. Thereafter, in response to the divided drive signal EI and the divided drive signal transfer clock ECK, the driver IC3 is sequentially activated, by which the electrothermal transducer 7 is selectively energized only during on-state of the pulse width setting signal ENB, by which the preliminary heating or the ink ejection is performed. Using the period, the shift register 4 receives the recording data or the preliminary heating data for the next line.

As described in the foregoing, in this embodiment, the pulse width of the pulse width setting signal ENB is such that the ink is not ejected when the pulse is for the preliminary heating (for example, approximately 0.5–5 micro-sec), and therefore, the pulse width is smaller than the pulse width during the ejection drive (recording operation) (approximately 3–10 micro-sec, for example). The preliminary heating data during the recording operation are the data provided by reversing the recording data for the previous line. However, upon the initial recording after the main switch is closed or when the resting period is long, the preliminary heating data is such data as to energize all the electrothermal transducer element 7. Therefore, all the liquid passages are assured to be subjected to the preliminary heating upon the initial recording after the main switch is actuated or after a long resting period.

The preliminary heating data during the recording operation are not limited to the data obtained by reversing the recording data for the previous line, and may be properly determined by one skilled in the art within the limitation that the effects of the preliminary heating do not disappear. For example, it is a possible alternative that the preliminary heating is executed only in the electrothermal transducer or transducers 7 which have been kept unenergized in continuous N lines. Further alternatively, it is possible that the preliminary heating is effected for all of the liquid passages every N lines of recording operations.

Figure 6:
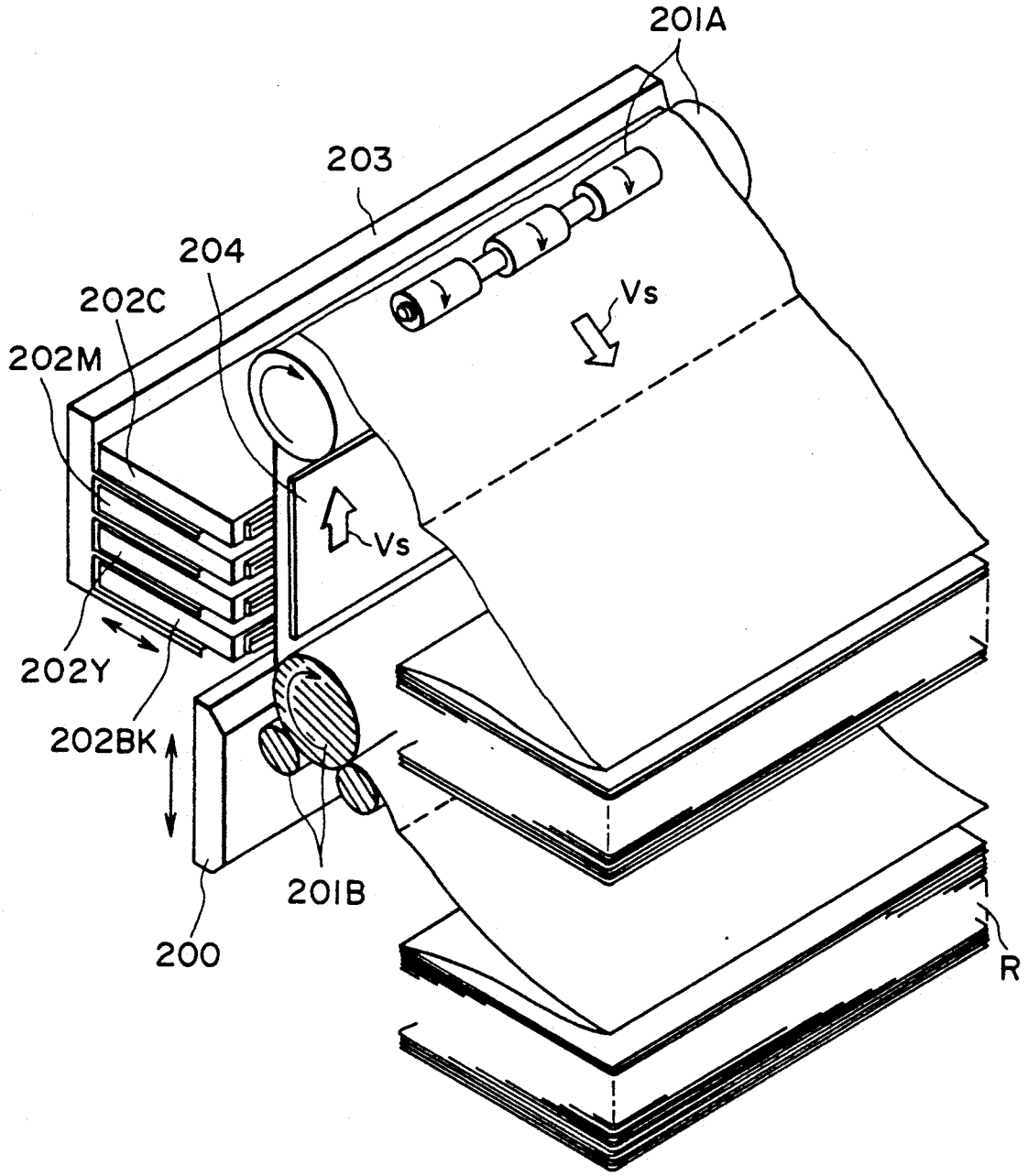
FIG. 6 is a perspective view of an ink jet recording apparatus using the recording head and the driving system, according to an embodiment of the present invention.

Using the recording head and the driving system described in the foregoing, a line printer capable of performing the full-color recording shown in FIG. 6 is possible.

In FIG. 6, the printer comprises a pair of rollers 201A and 201B constituting a nip therebetween to feed the recording material R (coated paper, plain paper, plastic resin sheet or the like) in a subordinate scanning direction Vs. It also comprises full-multi-type recording heads 202BK, 202Y, 202M and 202C for the black, yellow, magenta and cyan colors, respectively. Each of the recording heads has a number of nozzles enough to cover the entire width of the recording material R. The recording heads are mounted on the head mount 203 and are disposed in the order named from the upstream side in the direction of the recording material feed. Each of the recording heads has the structure similar to that shown in FIGS. 3 and 4, and therefore, the above-described drive control is performed.

The printer is provided with a recovery system 200 which is faced to the recording heads 202BK, 202Y, 202M and 202C in place of the recording medium R when the ejection recovery process is executed. More particularly, the head mount 203 is retracted, and the recovery system 200 enters the space provided by the retraction of the mount 203. Then, sucking operation or other non-recovery operations are performed. In this embodiment, the preliminary heating operation is carried out at proper intervals, and therefore, the number of ejection recovery operations can be remarkably reduced. A platen 204 functions to the gap between the recording material R and the ejection outlet of the recording head 202.

In the embodiments, the circuits for the driver IC may be of bi-polar, MOS type, BiCMOS type or the like, as desired. The recording head is not limited to that of the full-multi-type described above, it may be of a serial scan type. The method for applying to the electrothermal transducers the energy not enough to eject the liquid during the preliminary heating is not limited to the reduction of the pulse width as in the foregoing embodiment. It may be that the drive voltage in place of or in addition to the pulse width change may be changed. In any case, the electric power therefor is smaller than the electric power applied to the recording head for the recording operation.

In the foregoing embodiment, the electrothermal transducers 7 are grouped into a predetermined number of groups, and the groups are sequentially driven. If the number of the electrothermal transducers 7 is relatively small, or when the driving power source has sufficient power, it is not inevitable to carry out the divided driving operations, and all of the electrothermal transducers may be driven simultaneously.

Figure 7:
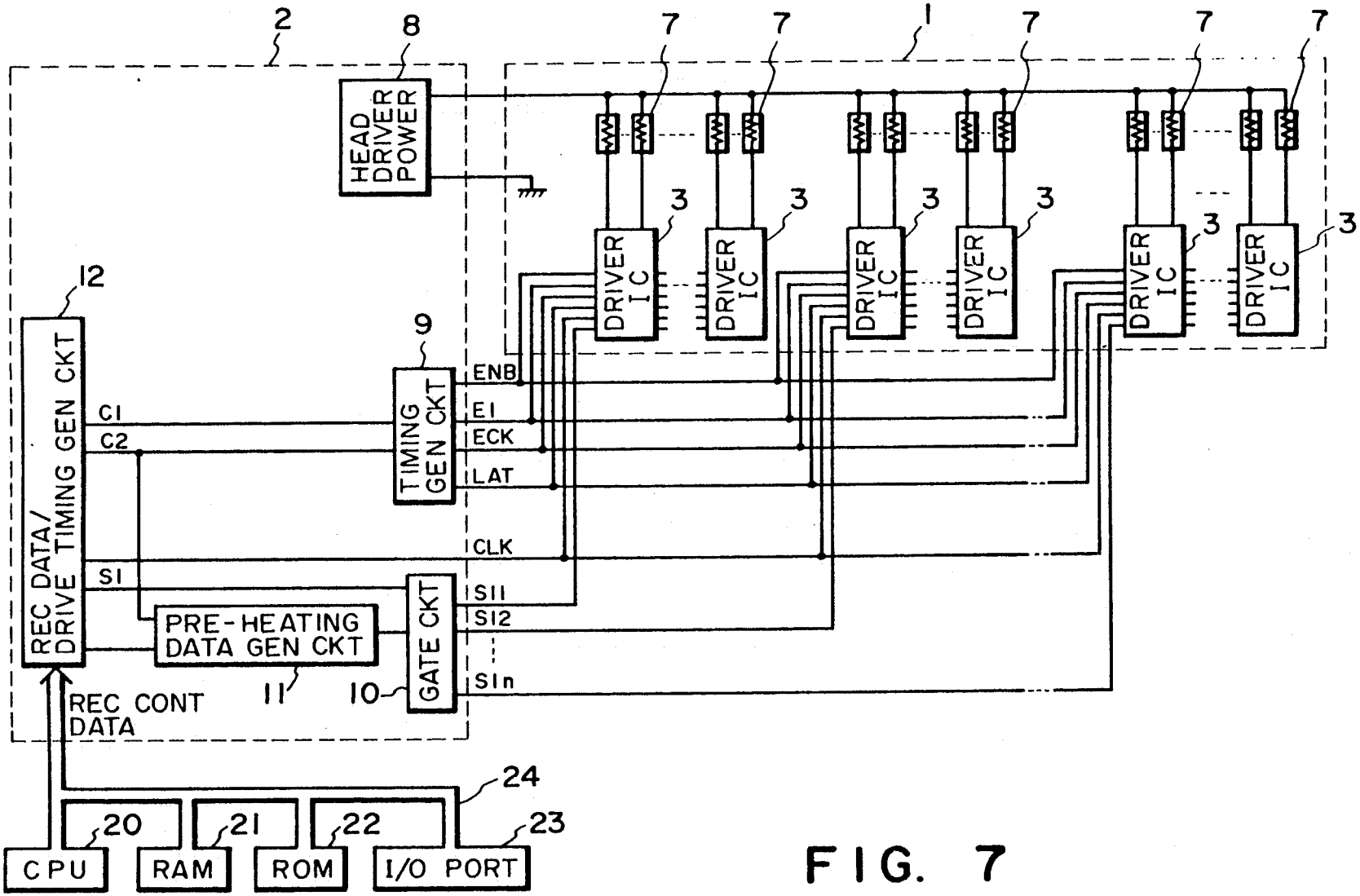
FIG. 7 is a block diagram showing an example of a recording head drive system according to another embodiment of the present invention.
Figure 8:
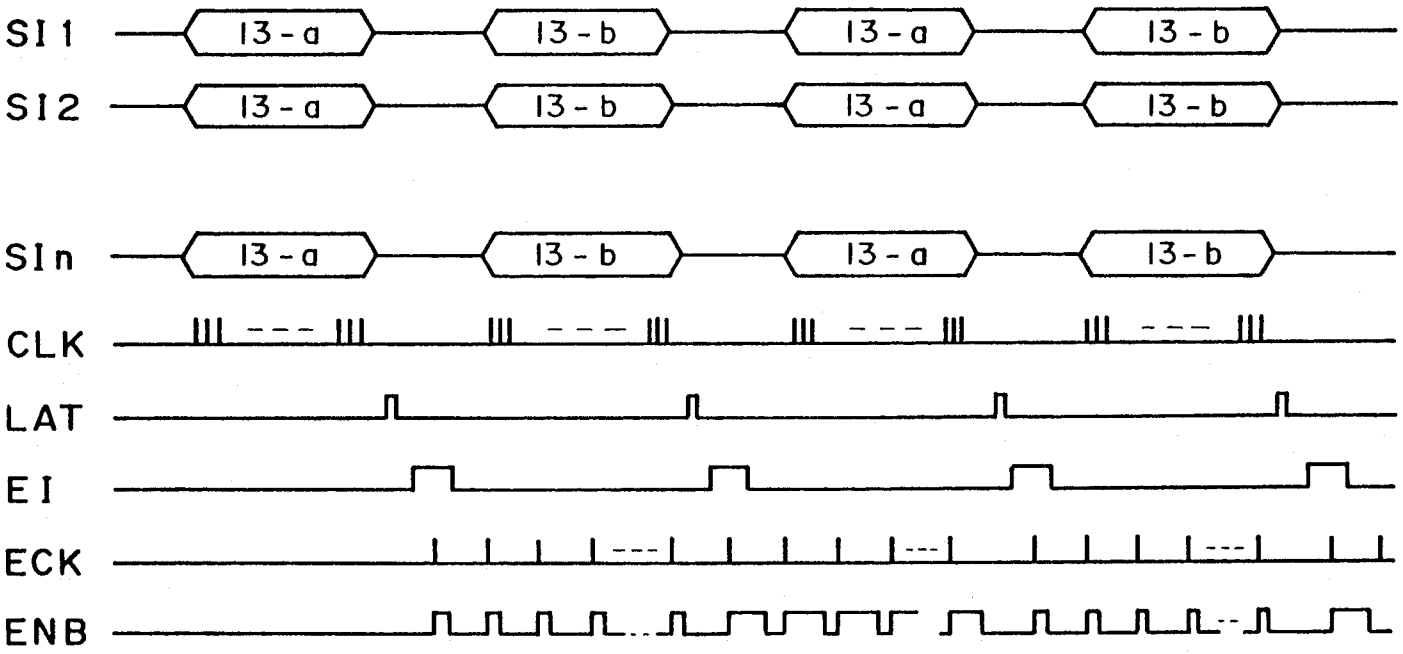
FIG. 8 is a timing chart showing the drive timing of the control system of FIG. 7.

Referring to FIG. 7, a structure for accomplishing a further high speed recording is shown, wherein the recording data are grouped to a desired number of blocks SI1–SIn. The recording data are supplied to the driver IC devices 3 for the respective blocks SI1–SIn, by which the operation can be performed at the times shown in FIG. 8.

As described in the foregoing, according to this embodiment, the data to be recorded (recording data) and the preliminary heating data are alternately supplied to carry out the liquid ejections and the preliminary heating operations alternately, by which the electrothermal transducer element corresponding to the ejection outlet through which improper ejection occurs due to lack or short of the ejection drive can be supplied with electric energy by the preliminary heating data. Therefore, the temperatures in all the liquid passages become uniform, so that good recording can be provided. In addition, the intervals of the recovery operations can be reduced, by which the overall recording speed is increased.

The description will be made as to an ink jet recording head, a driving device therefore and an ink jet recording apparatus equipped with them, which can use effectively the foregoing embodiment.

The ink jet recording head which will be described includes a plurality of electrothermal transducer elements producing thermal energy contributable to the ink ejection and driving means having a plurality of parallel current limiting elements connected to the electrothermal transducers for selecting in accordance with the data supplied thereto the current limiting element to permit the electrothermal transducers to be supplied with electric power enough to eject the ink or select the current limiting elements to supply electric current insufficient to eject the ink.

The driving device which will be described is used with the ink jet recording head having a plurality of electrothermal transducers for producing thermal energy contributable to the ink ejection, and comprises driving means including a parallel current limiting element connected to an electrothermal transducer to select in accordance with the data received thereby one of the current limiting element for permitting the electrothermal transducer to be supplied with electric power enough to eject the ink and for selecting another current limiting element for supplying electric current not enough to eject the ink.

The ink jet recording apparatus for recording on the recording material by ink ejection, which will be described, comprises an ink jet recording head provided with a plurality of electrothermal transducers for producing thermal energy contributable to the ink ejection, and driving means having plural electric current limiting elements connected to the electrothermal transducer elements, wherein the driving means selects one of the current limiting elements to permit the associated electrothermal transducer element to be supplied with electric energy enough for the ink ejection, or another current limiting element to supply it with current insufficient for the ink ejection.

According to this embodiment, the current flows through the selected current limiting element and the electrothermal transducer element connected thereto, in accordance with the data signal applied thereto. Thus, in accordance with the data signals, the preliminary heating drive and the ejection drive can be properly selected.

Now, the embodiment will be described in detail in conjunction with the drawings.

Figure 9:
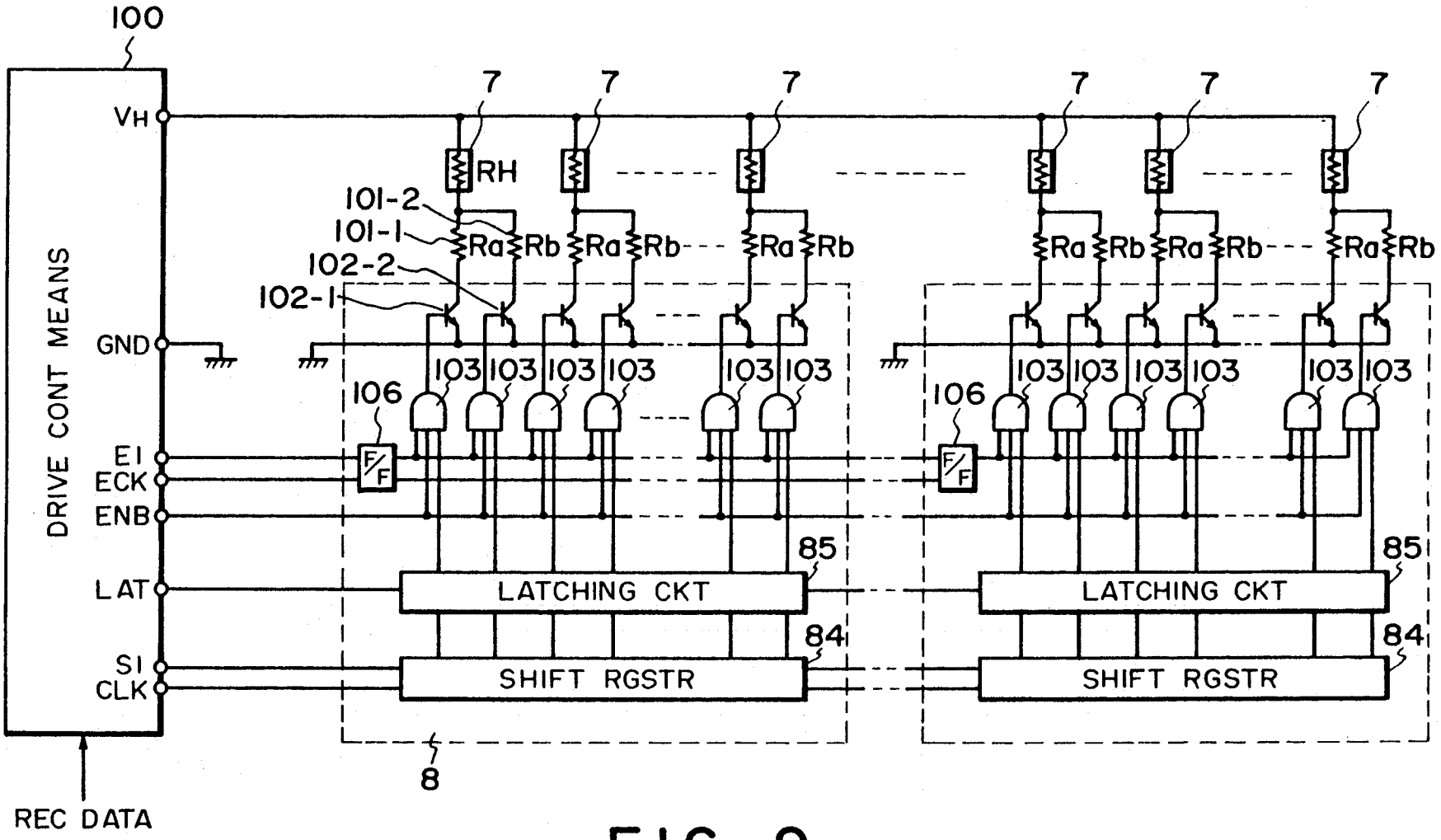
FIG. 9 is a block diagram of an example of a drive control system according to a further embodiment of the present invention.

FIG. 9 shows an electrical structure of the recording head having the mechanical structure shown in FIG. 3. In this embodiment, the driving circuit is integral with the substrate.

Further in this embodiment, two driving systems are provided for each of the electrothermal transducers corresponding to the ejection outlet 52. More particularly, the electrothermal transducer element 7 is connected to driving element 102-1 and 102-2 in the form of transistors in the driver IC8 through a current limiting resistor 101-1 having resistance of Ra and an electric current limiting resistor 101-2 having a resistance of Rb. An AND circuit 103 receives an output of a flip-flop circuit 106 and the pulse width setting signal ENB. The AND circuit is provided corresponding to each of the driving elements 102-1 and the driving elements 102-2. One electrothermal transducer 7 is driven by data having the same bit number as the driving element (2 bits in this embodiment). To accomplish this, the latching circuit 85 and the shift register 84 have the corresponding structure.

The data signal SI constituted by the same number of bits as the driving element 102 is sequentially supplied to the shift register 84 by the data transfer clock signals CLK, and is read in the latching circuit 85 by the latching signals LAT. In response to the divided driving signal EI and the divided drive signal transfer clock ECK, the driver IC80 are sequentially activated, and the driving element 102-1 and/or 102-2 is selectively actuated only during the on-state of the pulse width setting signal ENB. Each of the electrothermal transducers 7 corresponds to the data having the same bit number as the number of the driving elements connected thereto. In this embodiment it is driven by two bit data. When the data for driving the driving elements 102-1 and 102-2 are (0, 1), the current $I_{01}$ flows through the electrothermal transducer; when the data are (1, 0), the current $I_{10}$ flows therethrough; and when the data are (1, 1), the current $I_{11}$ flows therethrough, wherein $$I_{01}=[V_H-V_{OL}]/[R_H+Rb]$$

$$I_{10}=[V_H-V_{OL}]/[R_H+Ra]$$

$$I_{11}-[V_H-V_{OL}]/[R_H+RaRb/(Ra+Rb)]$$

where $V_H$ is a voltage of a driving voltage source, $V_{OL}$ is an output voltage of the driving element, $R_H$ is a resistance of the electrothermal transducer element, and Ra and Rb are resistance of the current limiting resistors. The resistances Ra and Rb of the current limiting resistors 101-1 and 101-2 are set such that the current $I_{11}$ is sufficient to eject the liquid, whereas the currents $I_{01}$ and $I_{10}$ are not sufficient to eject the liquid. Therefore, the current flowing through the electrothermal transducer element 7 can be selected from the three levels in accordance with the input data. Accordingly, the driving operations for the preliminary heating and the liquid ejection can be selected for each of the ejection outlets only by the input data.

The structure and the operation of the drive limiting means 100 for transmitting bias signals to such driving circuits to control the drive are as follows. For example, when a signal for liquid ejection drive for a certain electrothermal transducer element 7 on the basis of the recording data in which one bit corresponds to one ejection outlet, is "1", the data (1, 1) are produced; and when it is "0", the data (1, 0) or (0, 1) are produced. By making the resistances Ra and Rb different, the driving condition or conditions for the preliminary heating can be changed in accordance with the non-ejection-drive period of the electrothermal transducer 7 or the position thereof. In addition, it is possible that the larger current flows immediately after the main switch is actuated or after a long rest-period. Furthermore, the preliminary heating drive can be simultaneously effected during the one line recording operation. Alternatively, it may be performed for each several lines. Further alternatively, it can be performed at different timing from the ejection drive.

Using the recording head and the driving system described above, the line printer capable of full-color recording shown in FIG. 6 described hereinbefore can be constructed, for example.

The circuit of the driver IC may be of a bipolar type, MOS type, BiCMOS type or the like. The recording head is not limited to the full-multi-type as in the foregoing embodiments, but may be a serial scan type.

In the foregoing embodiment, the two driving elements are connected to each of the electrothermal transducer. However, three or more of the driving elements can be connected in which the liquid ejection driving current and the preliminary heating drive current may be controlled more finely, that is, with a larger number of levels, by properly selecting the resistances of the current limiting resistors. It is not inevitable that the current limiting resistors includes specific resistors disposed between the electrothermal transducer element and the driving elements, but it may be in the form of a wiring resistance of the wiring for connecting the electrothermal transducer and the driving elements.

Figure 10:
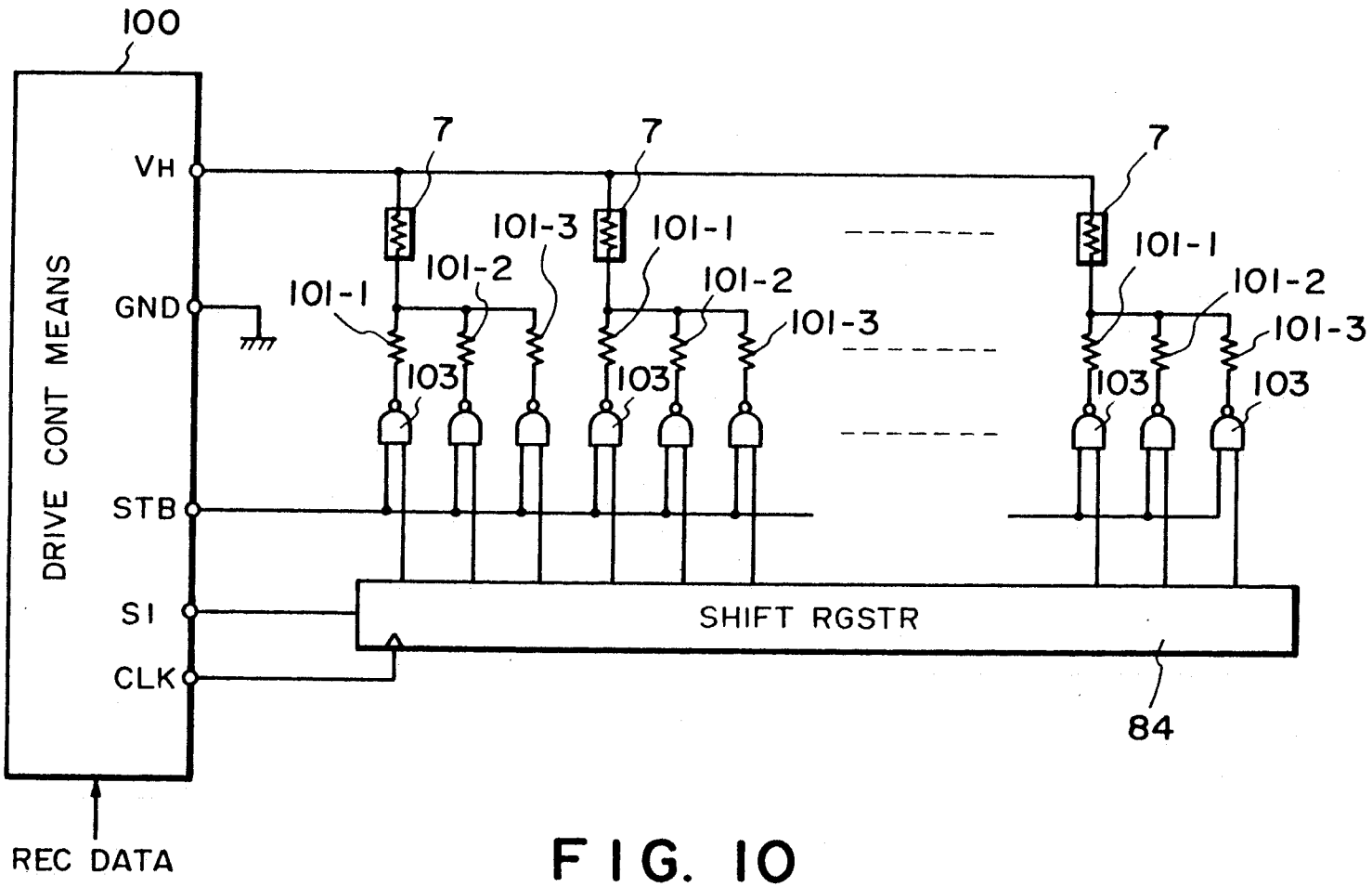
FIGS. 10 and 11 are block diagrams of recording head drive control system according to further embodiments of the present invention.

In the foregoing embodiment, the electrothermal transducer elements 7 are grouped into several unit blocks, and the blocks are sequentially driven. When, however, the number of elements 7 is relatively small, as shown in FIG. 10 or when the driving voltage has sufficient capacity, the simultaneous drive is possible in response to a strobe signal STB. In FIG. 10, three current limiting resistors 101-1, 101-2 and 101-3 are employed.

Figure 11:
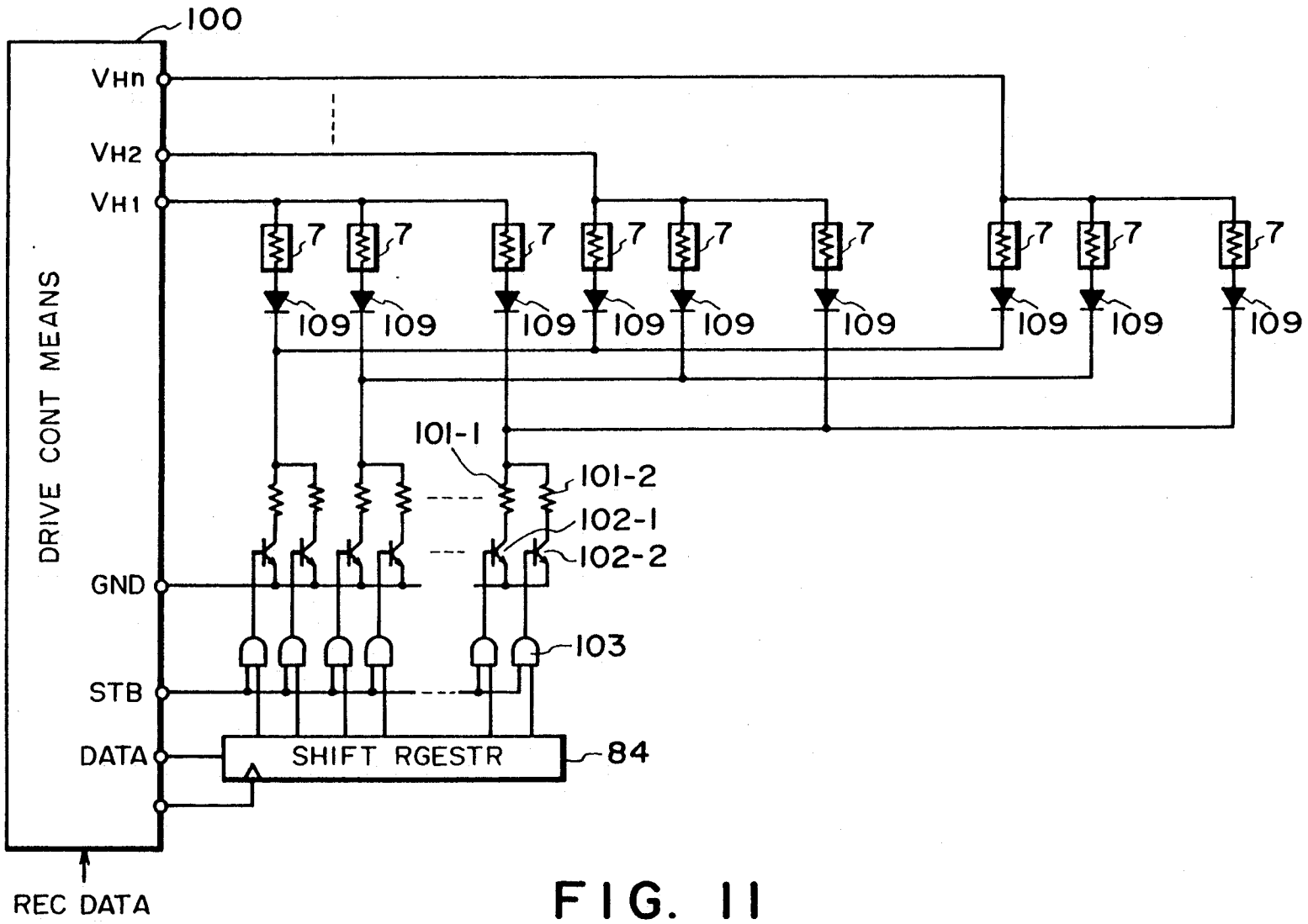

FIG. 11 shows another alternative wherein the power supply lines $V_{H1}$–$V_{Hn}$ are provided for the respective blocks, and a common driving system is provided, wherein the divided driving operation is effected. In FIG. 11, designated by a reference 109 is a diode for preventing reverse current.

Each of the foregoing embodiments is particularly suitable to a bubble jet type recording system among various ink jet recording systems.

It is preferable that the bubble jet recording system is based on the principle and has the structure as disclosed in U.S. Pat. Nos. 4,723,129 and 4,740,796. This system is usable with a so-called on-demand type apparatus and also with a continuous type apparatus. However, the on-demand type is preferable because the electrothermal transducers disposed faced to the sheet or liquid passages retaining the liquid (ink) are each supplied with at least one driving signal to produce quick temperature rise beyond nucleate boiling in accordance with the recording information, by which the electrothermal transducer produces thermal energy to produce film boiling on the heating surface of the recording head, so that one bubble can be formed in the liquid corresponding to one driving signal. By the development and contraction of the bubble, the liquid (ink) is ejected through the ejection outlet to form at least one droplet. The driving signal is preferably in the form of pulses, since then the bubbles are quickly developed and contracted, and therefore, the quick response liquid (ink) ejection can be accomplished. The pulse form driving signals are preferably as disclosed in U.S. Pat. Nos. 4,463,359 and 4,345,262. The temperature rise ratio of the heat applying surface is preferably as disclosed in U.S. Pat. No. 4,313,124 to further improve the recording operation.

The structure of the head may be the combination of the ejection outlet, liquid passage and the electrothermal transducer (linear liquid passage or perpendicularly bent passage) as disclosed in each of the above-mentioned U.S. Patents. Alternatively, the heating portion may be disposed at a bent portion as disclosed in U.S. Pat. Nos. 4,558,333 and 4,459,660. The embodiments described in the foregoing may be used with any of such structures. In addition, the structure in which the ejecting portions are constituted by slits each of which is common to plural electrothermal transducers, as disclosed in Japanese Laid-Open Patent Application No. 123670/1984, and the structure wherein an aperture is provided corresponding to the ejection part to absorb the pressure energy of the thermal energy, may be conveniently combined with the present embodiments.

Furthermore, each of the foregoing embodiments is conveniently incorporated in an exchangeable chip type recording head which can be electrically connected with the main apparatus and can be supplied with the ink from the main assembly by being mounted on the main assembly. It may be conveniently incorporated in a cartridge type recording head.

Each of the foregoing embodiments may preferably be provided with recovering means for the recording head and/or preliminary auxiliary means, since then the advantageous effects of each of the foregoing embodiments can be further stabilized. As for those means, there are capping means for the recording head, cleaning means, pressure or sucking means, preliminary heating means constituted by the electrothermal transducer and/or additional heating element, preliminary ejection mode operating means for ejecting the liquid not for the recording operation or the like.

The recording mode of the recording apparatus may include a monochromatic recording mode (black or another main color) and in addition it may also contain at least one of a multi-color mode and a full-color mode by an integral recording head or by combination of plural recording heads. The foregoing embodiments are particularly effective for such apparatus.

In the foregoing embodiments, the ink is described as liquid. However, it may be the ink which is solid under the room temperature or lower but is softened or liquefied under the temperature higher than the room temperature. In the ink jet recording apparatus described hereinbefore, the temperature of the ink is maintained within a range not lower than 30° C. and not higher than 70° C., generally in order to maintain the proper viscosity of the ink for the stabilized ejection. Therefore, what is required is that the ink is or becomes liquid upon application of the signal. The ink may be such that the thermal energy is consumed for the change of phase from the solid phase to the liquid phase to prevent the temperature rise due to the thermal energy or that the ink is solidified when it is left as it is for the purpose of preventing evaporation of the ink, if the ink is liquefied by the application of thermal energy as the recording signal, and the ink is ejected as liquid. Alternatively, the ink may be such that it starts to be solidified at the point of time when it reaches the recording material. Such ink which is liquefied by the application of the thermal energy are usable with the embodiments of the present invention. When such ink is used, the ink may be retained as liquid or solid material in the through holes or recesses of a porous sheet material, and the sheet material is faced to the electrothermal transducers. The foregoing embodiments are particularly suitable for the film boiling type recording apparatus using each of the ink materials. However, ink ejection energy producing means is not limited to the above-described electrothermal transducer, but it may be electromechanical transducer such as a piezoelectric element or the like, or it may be in the form of electromagnetic wave such as laser which is applied to the liquid and absorbed thereby to produce the heat which is contributable to eject the ink.

As described in the foregoing, according to the embodiments of the present invention, each of the electrothermal transducer elements corresponding to the ejection outlets can be selectively driven for the preliminary heating or for the liquid ejection in accordance with the input data, and therefore the temperatures of the ejection outlets are made uniform and high quality recording is possible with simple structure. In addition, the intervals of the ejection recovery operations can be extended, and therefore a high speed recording operation is possible.

Thus, according to the present invention, the ink jet recording head, a driving method for the same and the ink jet recording apparatus which can record with high recording quality, can be provided.

While the invention has been described with reference to the structures disclosed herein, it is not confined to the details set forth and this application is intended to cover such modifications or changes as may come within the purposes of the improvements or the scope of the following claims.

What is claimed is:

1. A recording method wherein an image is recorded on a recording material using a recording head including a plurality of heat generating elements, the heat generating elements being capable of causing a state change in ink to eject the ink upon the supply of sufficient electric power to the heat generating elements, the method comprising the steps of:

supplying electric power to all of the heat generating elements in accordance with first data upon actuation of a power source for the recording head or before the initiation of a recording operation, so that all of the heat generating elements produce heat;

selectively supplying electric power to particular heat generating elements, in accordance with recording data, to eject ink and record on the recording material; and supplying, after completion of a recording operation for recording a predetermined amount of recording data and before the initiation of another recording operation, electric power insufficient to cause ink ejection to the heat generating elements which have not been used in the recording operation, in accordance with second data.

2. A method according to claim 1, wherein the recording heat includes plural ink ejection outlets corresponding to the heat generating elements, and the ejection outlets are arranged in a line covering an entire width of a record area of the recording material so that recording on the recording material is effected line by line in accordance with the recording data.

3. A method according to claim 2, wherein the second data is provided by reversing a previous line of recording data.

4. A method according to claim 2 or 3, wherein the predetermined amount of recording data corresponds to one or more lines thereof.

5. A method according to claim 1, wherein in the step of supplying electric power to all of the heat generating elements in accordance with first data, the electric power is insufficient to eject ink.

6. A recording apparatus wherein an image is recorded on a recording material using a recording head including a plurality of heat generating elements, the heat generating elements being capable of causing a state change in ink to eject the ink upon the supply of sufficient electric power to the heat generating elements, the apparatus comprising:

driving means for supplying electric power to actuate the heat generating elements in accordance with data; and supply means for supplying data to said driving means, wherein said supply means supplies to said driving means first data for actuating all of the heat generating elements upon actuation of a power source for the recording head or before the initiation of a recording operation, recording data for selectively actuating particular heating elements to eject ink and record on the recording material, and second data for providing, after completion of a recording operation for recording a predetermined amount of recording data and before the initiation of another recording operation, electric power insufficient to cause ink ejection to the heat generating elements which are not used in the recording operation.

7. An apparatus according to claim 6, wherein the recording head includes plural ink ejection outlets corresponding to the heat generating elements, and the ejection outlets are arranged in a line covering an entire width of a record area of the recording material so that recording on the recording material is effected line by line in accordance with the recording data.

8. An apparatus according to claim 7, wherein the second data is provided by reversing a previous line of recording data.

9. An apparatus according to claim 7 or 8, wherein the predetermined amount of recording data corresponds to one or more lines thereof.

10. An apparatus according to claim 6, wherein the electric power supplied in accordance with the first data is insufficient to eject ink.

11. A recording method wherein an image is recorded on a recording material using a recording head including a plurality of heat generating elements, the heat generating elements being capable of causing a state change in ink to eject the ink upon the supply of sufficient electric power to the heat generating elements, the method comprising the steps of:

providing storing means having a memory area corresponding to the plural heat generating elements for storing driving data;

storing in a portion of said memory area first data for those heat generating elements by which ink is to be ejected;

storing in another portion of said memory area second data for those heat generating elements by which ink is not to be ejected;

simultaneously supplying electric power to the heat generating elements in accordance with the first and the second data stored in the storing means, wherein the electric power supplied in accordance with the second data is insufficient to cause ink ejection.

12. A method according to claim 11, wherein the electric power supplied to the heat generating elements is selected in accordance with the first and the second data.

13. A method according to claim 12, wherein the heat generating elements are electrically connected with plural current limiting elements and in accordance with the first and the second data particular limiting elements are selected to control the electric power supplied to the heat generating elements.

14. A method according to claim 11, wherein the recording head includes plural ink ejection outlets corresponding to the heat generating elements, and the ejection outlets are arranged in a line covering an entire width of a recording area of the recording material, so that recording on the recording material is effected line by line in accordance with the first data.

15. A recording apparatus wherein an image is recorded on a recording material using a recording head including a plurality of heat generating elements, the heat generating elements being capable of causing a state change in ink to eject the ink upon the supply of sufficient electric power to the heat generating elements, the apparatus comprising:

storing means having a memory area corresponding to the plural heat generating elements for storing driving data;

data generating means for supplying to said storing means, in accordance with the image to be recorded, first data for those heat generating elements by which ink is to be ejected and second data for heat generating elements by which ink is not to be ejected; and driving means for simultaneously supplying electric power to the heat generating elements in accordance with the first and the second data stored in said storing means, wherein the electric power supplied in accordance with the second data is insufficient to cause ink ejection.

16. An apparatus according to claim 15, wherein said driving means includes selecting means for selecting the amount of electric power supplied to the heat generating elements in accordance with the first and the second data.

17. An apparatus according to claim 16, wherein said selecting mean includes plural current limiting elements electrically connected with the heat generating elements and selects particular limiting elements in accordance with the first and the second data to control the electric power supplied to the heat generating elements.

18. An apparatus according to claim 15, wherein the recording head includes plural ink ejection outlets corresponding to the heat generating elements, and the ejection outlets are arranged in a line covering an entire width of a record area of the recording material, so that recording on the recording material is effected line by line in accordance with the first data.

* * * * *

UNITED STATES PATENT AND TRADEMARK OFFICE

CERTIFICATE OF CORRECTION

PATENT NO. : 5,172,134

DATED : December 15, 1992

INVENTOR(S) : HIDEAKI KISHIDA ET AL.

It is certified that error appears in the above-identified patent and that said Letters Patent is hereby corrected as shown below:

IN THE DRAWINGS:

SHEET 11 OF 11

FIG. 11, "RGESTR" should read --RGSTR--.

COLUMN 3

Line 13, "proposes the" should read --proposes that the--.
Line 19, "proposes the" should read --proposes that the--.
Line 25, "proposes the" should read --proposes that the--.

COLUMN 4

Line 50, "not enough to the" should read --insufficient to--.

COLUMN 5

Line 6, "store" should read --stores--.

COLUMN 11

Line 25, "are" should read --is--.

COLUMN 13

Line 19, "heat" should read --head--.

UNITED STATES PATENT AND TRADEMARK OFFICE

CERTIFICATE OF CORRECTION

PATENT NO. : 5,172,134

DATED : December 15, 1992

INVENTOR(S) : HIDEAKI KISHIDA ET AL. Page 2 of 2

It is certified that error appears in the above-identified patent and that said Letters Patent is hereby corrected as shown below:

COLUMN 14

Line 25, "ejected;" should read --ejected; and--.

COLUMN 15

Line 9, "mean" should read --means--.

Signed and Sealed this

First Day of February, 1994

Bruce Lehman

*Attest:*

BRUCE LEHMAN

*Attesting Officer*

*Commissioner of Patents and Trademarks*